United States Patent [19]

Seilly

[11] Patent Number: 4,601,274

[45] Date of Patent: Jul. 22, 1986

[54] FUEL PUMPING APPARATUS

[75] Inventor: Alec H. Seilly, North Wembley, England

[73] Assignee: Lucas Industries, Birmingham, England

[21] Appl. No.: 753,372

[22] Filed: Jul. 10, 1985

[30] Foreign Application Priority Data

Jul. 13, 1984 [GB] United Kingdom ..... 8417862

[51] Int. Cl.[4] ..... F02M 39/00

[52] U.S. Cl. ..... 123/450; 123/447; 123/458; 417/462

[58] Field of Search ..... 123/450, 447, 458, 446; 417/462

[56] References Cited

U.S. PATENT DOCUMENTS

| | | | |
|---|---|---|---|
| 4,428,346 | 1/1984 | Hoshi | 417/462 |
| 4,445,822 | 5/1984 | Hoshi | 417/462 |
| 4,450,813 | 5/1984 | Takano | 417/462 |
| 4,492,200 | 1/1985 | Takahashi | 123/450 |
| 4,492,534 | 1/1985 | Miyaki | 417/462 |
| 4,498,442 | 2/1985 | Tissoi | 123/447 |
| 4,526,149 | 7/1985 | Hafele | 123/447 |
| 4,538,580 | 9/1985 | Straubel | 123/458 |
| 4,562,815 | 1/1986 | Takano | 417/462 |

*Primary Examiner*—Carl Stuart Miller

[57] ABSTRACT

A fuel pumping apparatus for supplying fuel to an internal combustion engine includes a positively reciprocated plunger which during movement in a fuel delivery direction displaces fuel from a first chamber and draws fuel into a second chamber and vice versa. The fuel displaced from the first chamber is used to displace a shuttle towards one end of a cylinder from which extends an outlet. Fuel displaced from the second chamber is used initially to displace the shuttle away from the one end of a cylinder until a control valve is closed and is then supplied to an accumulator which before the control valve is closed supplies fuel to the first chamber.

12 Claims, 8 Drawing Figures

FUEL PUMPING APPARATUS

This invention relates to a fuel pumping apparatus for supplying fuel to a combustion chamber of a compression ignition engine.

The object of the invention is to provide an apparatus for the purpose specified in a simple and convenient form.

According to the invention a pumping apparatus for the purpose specified comprises in combination, a pumping plunger housed within a bore, means driven by a drive shaft which is connected in use to or forms part of a rotary part of the engine for positively reciprocating the plunger within the bore, the bore defining with the plunger first and second pump chambers, the volume of the second chamber increasing and that of the first chamber decreasing during movement of the plunger in a fuel delivery direction and vice versa as the plunger is moved in the opposite fuel filling direction, a shuttle slidable within a cylinder, an outlet from one end of the cylinder for connection in use to a fuel injection nozzle of the associated engine, a fuel inlet to said second chamber, a first non-return valve in said fuel inlet arranged to allow fuel flow into said second chamber, an accumulator in which fuel can be stored under pressure, a second non-return valve in a conduit connecting said second chamber with said accumulator, first valve means operable to connect said second chamber with said one end of the cylinder whereby during movement of the plunger in the filling direction fuel will flow to said one end of the cylinder and displace said shuttle, said second non-return valve being set to open at a higher pressure than is required to cause movement of the shuttle, an electromagnetically operated valve connected in a flow path between the other end of the cylinder and the accumulator, said electromagnetically operable valve being operable to prevent escape of fuel from the other end of the cylinder during movement of the shuttle away from said one end of the cylinder thereby to determine the excursion of the shuttle, second valve means operable to connect said first chamber with said accumulator during movement of the pumping plunger in the filling direction and third valve means operable to connect said first chamber with the other end of the cylinder during movement of the pumping plunger in the pumping direction.

Figure 1:
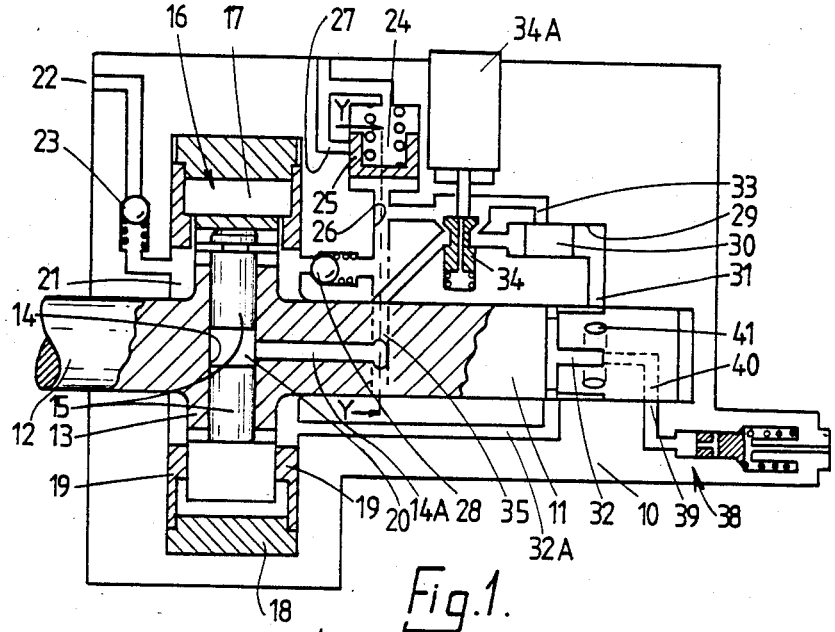
Figure 2:
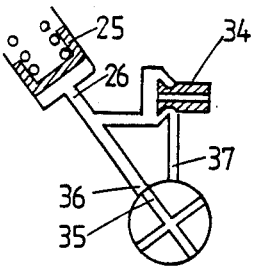
Figure 4:
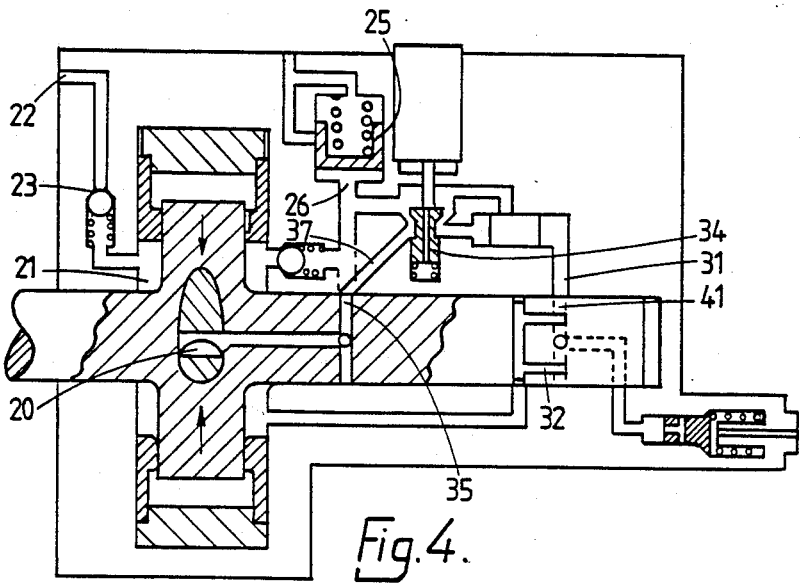
Figure 5:
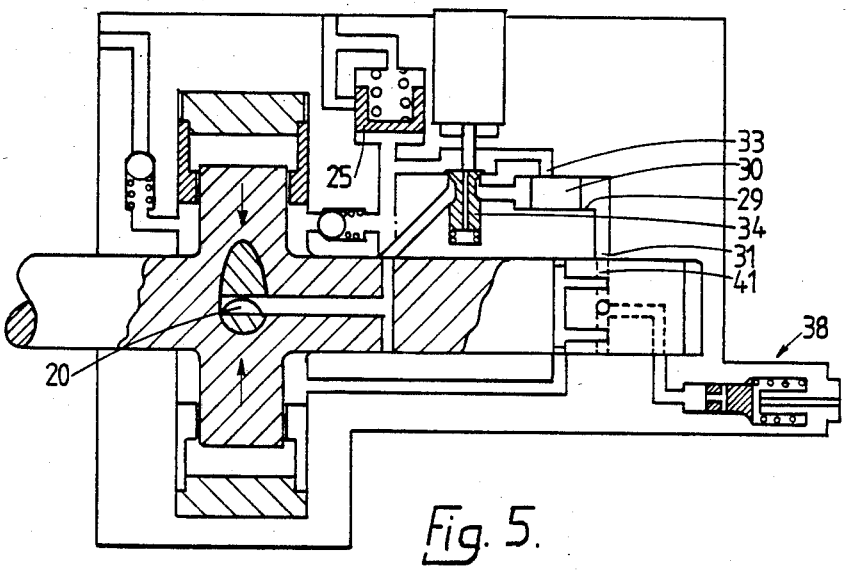
Figure 6:
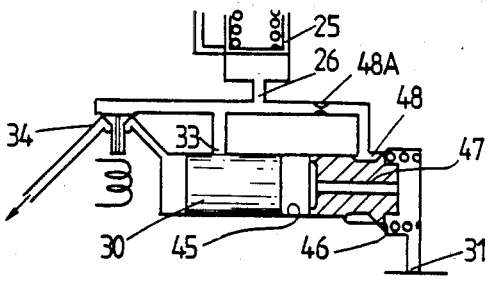
Figure 7:
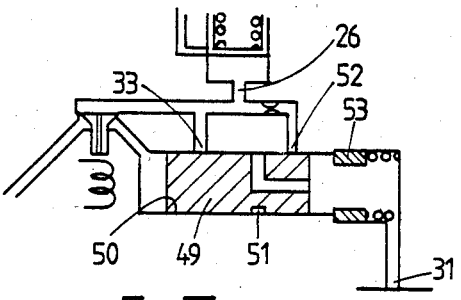
Figure 8:
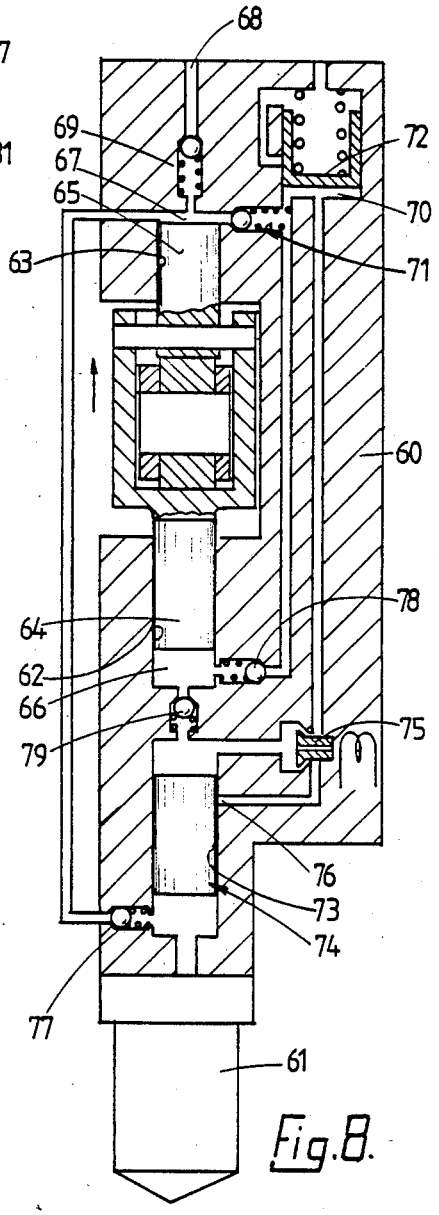

Examples of apparatus in accordance with the invention will now be described with reference to the accompanying drawings in which:

FIG. 1 is a diagrammatic sectional side elevation of one example of the apparatus, FIG. 2 is a section on the line Y—Y of FIG. 1, FIGS. 3–5, are views similar to FIG. 1 showing parts of the apparatus in different positions, FIGS. 6 and 7 show modifications to the apparatus, and FIG. 8 shows another example of the apparatus.

Referring to FIGS. 1–5 of the drawings the apparatus comprises a body part 10 in which is mounted a rotary distributor member 11 which in the particular example, is integrally formed with a drive shaft 12 which projects from the body part 10 and which in use is adapted to be coupled to a rotary part of the associated engine so that the distributor member rotates in timed relationship with the engine.

The distributor member has an enlarged portion 13 in which is formed a transversely extending bore 14, the bore mounting a pair of pumping plungers 15 which are positively connected to cam followers 16, each cam follower including a shoe captively mounting a roller 17. Surrounding the enlarged portion of the distributor member is an annular cam ring 18 which on its internal peripheral surface, has in the particular example, four equiangularly spaced cam lobes which can impart inward movement to the plungers 15, such inward movement being referred to as movement in the pumping direction. In addition, there is mounted in the body on opposite sides of the cam followers, a further pair of cam rings 19 which define cam surfaces presented to the rollers, the cam surfaces in the example, being complementary to the internal surface of the cam ring 18. The surfaces on the cam rings 19 impart outward movement to the cam followers and pumping plungers, such outward movement being referred to as movement in the filling direction. The cam surfaces and cam lobes are shaped whenever possible, such that movement of the pumping plungers in the pumping direction i.e. inward movement, takes place over a smaller range of angular rotation of the distributor member as compared with the outward or filling movement of the plungers. It will of course be appreciated that there are as many cam lobes as there are cylinders of the associated engine. For an apparatus which supplies fuel to a four cylinder engine, the inward movement of the plungers takes place over 30° of angular movement of the distributor member while the outward movement of the plungers takes place over 60° of rotation of the distributor member.

Intermediate the plungers there is defined a so-called first pump chamber 20 and a second pump chamber 21 is formed by a space defined in the body part and into which the outer ends of the plungers 15 extend. It will be appreciated that as the plungers 15 are moved inwardly the volume of the chamber 20 decreases and the volume of the chamber 21 increases by the same amount.

The chamber 21 communicates with a fuel inlet 22 formed in the body part and for controlling fuel flow through the inlet 22 there is provided a first non-return valve 23. This is spring loaded to the closed position and can be opened to allow fuel flow into the chamber 21 during inward movement of the plungers.

Also provided is an accumulator and this comprises a chamber 24 formed in the body part and in which is slidable a spring loaded piston 25 which is biased towards the inlet opening 26 of the accumulator. Moreover, in the side wall of the chamber is formed a relief port 27 through which fuel can flow to a drain when the piston has moved a predetermined extent against the action of its spring. A second spring loaded non-return valve 28 is located within a conduit extending between the second pump chamber and the inlet 26 of the accumulator and the valve 28 is positioned so as to allow fuel flow from the second chamber to the inlet of the accumulator as will be described.

Also provided is a cylinder 29 in which is located a slidable shuttle 30. One end of the cylinder 29 is connected to a port 31 which opens onto the periphery of the distributor member at a position where it can register in turn with a plurality of equiangularly spaced grooves 32 which are in constant communication by way of a circumferential groove in the distributor member and a passage 32A in the body part 10, with the second pump chamber 21. The port 31 and the grooves 32 constitute a first valve means.

In the wall of the cylinder 29 is formed a spill port 33 which is in constant communication with the inlet of the accumulator.

The other end of the cylinder 29 can communicate with the inlet 26 of the accumulator by way of a valve member 34 operable by means of a solenoid actuator 34A. In FIGS. 1 and 2 the valve 34 is shown to be in the open position.

The first pump chamber 20 communicates by way of a longitudinal passage 14A in the distributor member, with in the particular example, four radially extending passages 35, these extending to the periphery of the distributor member and being equiangularly spaced. The passages 35 form with a port 36, a second valve means, the port 36 being in constant communication with the inlet 26 of the accumulator. In addition, the passages 35 form with a further port 37 a second valve means, the port 37 being in constant communication with the other end of the cylinder 29. As will be seen from FIG. 2 the ports 36 and 37 are angularly displaced, the extent of displacement in the particular example, being of the order of 45°.

The apparatus includes a plurality of outlets 38 only one of which is shown, for connection to the fuel injection nozzles respectively of the associated engine. In the particular example, each outlet incorporates a non-return delivery valve. The outlets open to ports 39 respectively opening onto the periphery of the distributor member 11 and the latter is provided with a delivery passage 40 which is in constant communication with a plurality of ports 41 opening onto the periphery of the distributor member. The ports 41 are in axial alignment with the port 31 and are alternately positioned with the grooves 32.

The operation of the apparatus will now be described by referring to FIGS. 1, 3, 4 and 5 in sequence and considering firstly the disposition of the various parts of the apparatus seen in FIG. 1. In FIG. 1 the electromagnetic valve 34 is open and the port 31 is in communication with a groove 32. In addition, the port 36 is in communication with a passage 35. As the plungers 15 are moved outwardly, fuel is displaced from the pump chamber 21 due to the reduction in volume thereof and fuel is therefore supplied to the aforesaid one end of the cylinder by way of one of the grooves 32 and the port 31. The second non-return valve 28 remains closed since its spring loading is such as to ensure that the fuel flows to the cylinder 29 and displaces the shuttle. The fuel which is displaced from the cylinder 29 by movement of the shuttle flows to the inlet 26 of the accumulator. At the same time however fuel is supplied to the pump chamber 20, this fuel flowing by way of the port 36 and a passage 35. This fuel is supplied from the accumulator and the aforesaid other end of the cylinder. The flow of fuel to the one end of the cylinder takes place when a groove 32 is brought into register with a port 31 and this can be delayed slightly to ensure that the fuel in the pump chamber 21 is pressurised to close any cavities which might be present in the pump chamber 21.

Figure 3:
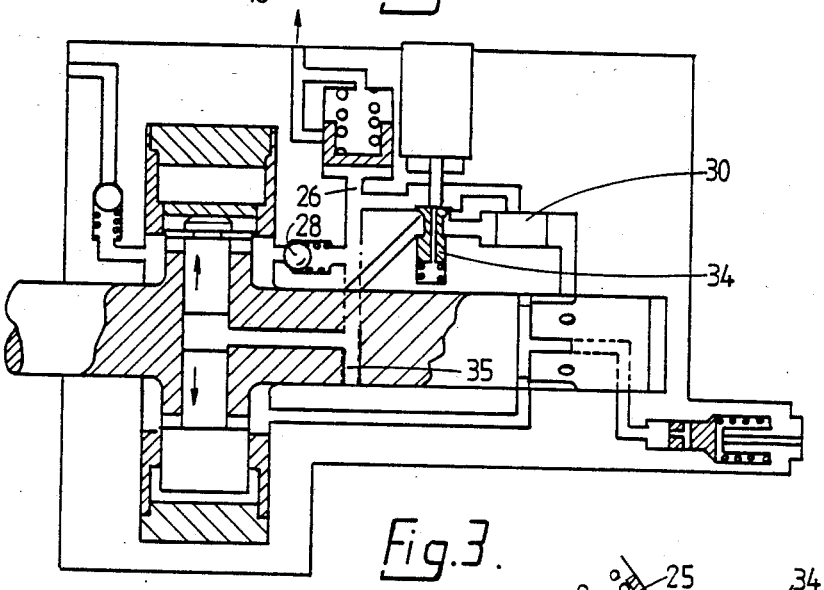

The valve 34 is closed after the shuttle has undergone a predetermined movement. This movement is determined by reference to the profile of the trailing faces of the cam lobes and the number of degrees of rotation of the distributor member. When it is judged that sufficient fuel has been delivered to the one end of the cylinder 29 the valve 34 is closed thereby preventing further movement of the shuttle since the valve blocks the connection between the other end of the cylinder and the inlet 26 of the accumulator and the port 37 which does communicate with the other end of the cylinder 29, is closed off from the passages 35 by the distributor member. Although movement of the shuttle 30 is halted, the plungers 16 continue to move outwardly and since no more fuel can enter the one end of the cylinder 29 due to the fact that the shuttle can no longer move, the fuel flows from the chamber 21 by way of the valve 28 to the inlet 26 of the accumulator. FIG. 3 shows the valve 34 closed and thereby the movement of the shuttle halted. The displacement of fuel from the pump chamber 21 continues until the plungers have moved outwardly their maximum extent it being understood, that the pump chamber 20 is completely filled with fuel.

Turning now to FIG. 4 this shows the start of the inward movement of the plungers and it shows the distributor member 11 in a different position such that a passage 35 now registers with the port 37, a port 41 communicates with the port 31 and the grooves 32 are blocked off. Inward movement of the plungers 15 causes displacement of fuel from the pump chamber 20 and since the valve member 34 is now open, this fuel flows by way of the port 37, and the open valve 34 to the inlet 26 of the accumulator thereby moving the piston 25 against the action of its spring. At the same time, the volume of the chamber 21 is increasing and this creates a depression in the chamber such as to open the valve 23 and draw fuel in through the inlet 22. If now as shown in FIG. 5, the valve 34 is closed the fuel flowing from the pump chamber 20 flows to the other end of the cylinder 29 and the shuttle 30 is displaced towards the one end of the cylinder and fuel flows through the port 31 and a port 41 communicating therewith, to an outlet 38. Fuel is therefore displaced to the associated engine and the quantity of fuel which is displaced depends upon the movement of the shuttle 30 which takes place before the shuttle uncovers the port 33 in the cylinder 29. When the port 33 is uncovered the remaining volume of fuel which is displaced from the pump chamber flows to the inlet 26 and effects further movement of the accumulator piston 25 against the action of its spring. Such displacement of fuel will continue as long as inward movement of the plungers takes place.

As the distributor member continues to rotate the various communications shown in FIG. 1 are established and the valve member 34 is moved to the open position. The plungers 15 now start to move outwardly and as previously described, fuel displaced from the pump chamber 21 flows to the one end of the cylinder 29 containing the shuttle which therefore moves towards the opposite end of its cylinder. The process is then repeated. As fuel is spilled to the accumulator during operation of the apparatus, its piston will start to uncover the port 27 to allow the surplus fuel to flow to the drain. During a cycle of operation the valve 34 is closed twice the first closure being to determine the quantity of fuel which will be delivered at the next delivery stroke of the apparatus and the second time to initiate the start of delivery of fuel.

With the design as described, failure of the actuator for the valve 34 will result in the valve 34 remaining in the open position and in this position although the shuttle 30 will move its maximum extent during outward movement of the plungers 15, there will be no delivery of fuel through an outlet 38 because during the inward movement of the plungers, the fuel displaced from the pump chamber 20 will flow directly to the accumulator and will not cause movement of the shuttle. In subsequent cycles of operation the shuttle will not therefore move at all. Failure of the valve in the closed position will also cause the supply of fuel to be halted since in this case the shuttle 30 at the end of an injection period will remain at the right hand end of the cylinder 29 during the following filling period.

It is also possible with the apparatus as described, to obtain pilot injection of fuel. This is achieved by opening the valve 34 following its initial closure to cause delivery of fuel, and then reclosing the valve so that the remaining quantity of fuel is delivered.

The allowed excursion of the shuttle 30 must be at least equal to the maximum amount of fuel it will ever be required to supply to the associated engine. For engines which do not require any excess of fuel for starting purposes, it is possible to arrange a mechanical stop to limit the extent of movement of the shuttle and thereby provide a maximum fuel stop. For engines which do require an excess of fuel for starting purposes, this is not possible.

The valve 34 has to be designed with some care and the ideal is for its valve member to close when the solenoid of the associated actuator is energised. By careful design of the actuator it is possible to minimise valve bounce. Alternatively the valve member can be spring loaded to the closed position and urged to the open position by the actuator. This however does pose problems with valve bounce.

As described the valve 34 is closed twice during a cycle of operation, once to terminate the flow of fuel out of the other end of the cylinder 29 during shuttle movement the start of shuttle movement depending on the registration of a groove with a port, and once to start delivery of fuel. In both cases it is the same movement of the valve i.e. the closing of the valve which is critical and the valve and its actuator can be designed with this in mind. It is however possible to arrange that the valve is closed once during the cycle with the valve being closed to initiate delivery of fuel to the associated engine and then remaining closed so as to prevent shuttle movement, while allowing the plungers to move outwardly. The valve will be opened to permit shuttle movement away from said one end of the cylinder at an appropriate time in the outward movement of the plungers. In this case however the opening of the valve is also critical and the design of the valve and its actuator is more critical.

With the apparatus as described the termination of fuel delivery will not result in an appreciable reduction in the pressure of fuel at the injection nozzle and therefore the end of delivery of fuel to the engine may be comparatively slow. In order to speed up the process of ending delivery of fuel the apparatus as described can be modified as shown in FIG. 6.

The parts of the apparatus seen in FIG. 6 which have the same function as those described earlier have been assigned the same reference numerals. In this case the shuttle 30 is slidable within a cylinder 45 which is longer than the cylinder 29. Adjacent the one end of the cylinder there is defined a seating 46 for a valve member 47 the main portion of which is slidable within the cylinder 45. The valve member has a head for engagement with the seating and an annular space is defined beneath the head, the space referenced 48, being connected to the inlet 26 of the accumulator by way of a restrictor 48A. Moreover, the valve member is spring biased into contact with the seating and is provided with a central drilling extending between the ends thereof.

The one end of the cylinder is connected to the port 31. The position of the parts shown in FIG. 6 represents the end of the filling stroke of the shuttle, the valve 34 being closed. When the plungers 15 start to move inwardly with the spill valve closed, the shuttle 30 will be moved as described, towards the one end of the cylinder 45 and fuel will be displaced to the port 31, the fuel flowing by way of the drilling in the valve member 47. It is arranged that just prior to the port 33 being uncovered by the shuttle, the latter engages the valve member 47 to lift the head of the valve member from the seating. The pressure in the one end of the cylinder therefore falls quickly to the pressure pertaining in the accumulator and this reduction in pressure brings about a rapid termination of the delivery of fuel to the associated engine. The shuttle 30 will continue to move until the port 33 is uncovered thereby allowing the surplus fuel delivered from the first pump chamber 20 to flow to the accumulator. When the inward movement of the plungers 15 ceases so that fuel is no longer supplied to the other end of the cylinder, the valve member 47 will move to the closed position under the action of its spring and will also displace the shuttle 30 away from the one end of the cylinder to cover the port 33. If the valve 34 is maintained closed the pressure in the outlet will be reduced to that determined by the accumulator 25.

As an alternative to connecting the annular space 48 to the inlet of the accumulator, it may be connected by way of a restrictor, to a drain so that the pressure in the port 41 and the associated passage 40 and ports 39 will be reduced to a low value.

It has been mentioned that in the situation where it is not necessary to supply an excess of fuel to the associated engine for starting purposes, a maximum fuel stop can be provided to limit the movement of the shuttle 30 away from the one end of the cylinder. The maximum fuel stop can take the form of a mechanical stop for example, an adjustable screw mounted in the other end of the cylinder or it may take the form of a further port extending from the cylinder 29 or 45 at a position to be uncovered by the end of the shuttle adjacent the one end of the cylinder, after the shuttle has moved the maximum extent. The port may be connected to the inlet 26 of the accumulator and it will have the effect when uncovered of causing both ends of the shuttle to be exposed to the pressure within the accumulator thereby halting the movement of the shuttle.

As an alternative to the construction shown in FIG. 6, the arrangement of FIG. 7 may be provided in which the shuttle 49 is slidable in a cylinder 50 and is provided on its periphery, with a circumferential groove 51, the groove communicating by way of drilling formed in the shuttle, with the one end of the cylinder. The groove 51 prior to the port 33 being uncovered by the shuttle, registers with a port 52 extending into the cylinder and communicating with the inlet 26 of the accumulator. As a result, the pressure in the one end of the cylinder is reduced prior to uncovering the port 33. In order to prevent overtravel of the shuttle, a spring loaded collar 53 is provided in the one end of the cylinder and this collar is engaged by the shuttle just before the groove 51 registers with the port 52. The fact that the collar is spring loaded means that when the plungers 15 have moved inwardly to their maximum extent, the shuttle will be returned to a position in which the port 52 is just closed off to the circumferential groove 51. As with the previous example, the port 52 may be connected by way of a restrictor to a drain rather than to the inlet of the accumulator. Moreover, the port 52 can be positioned so that it is uncovered by the end of the shuttle 49 at the one end of the cylinder so that a maximum fuel stop is obtained.

The apparatus as described can be modified by driving the distributor member from the opposite end to that shown. This facilitates the sealing arrangements of the apparatus and in particular avoids the need to provide a seal between the drive shaft and the body of the apparatus which can withstand the pressure of fuel in the chamber 21. It is also possible to locate the shuttle in the distributor member instead of in the body part.

The apparatus described with reference to the preceding drawings is for supplying fuel to a multi-cylinder engine and the outlets of the apparatus are connected, as is well known, by individual pipelines to the injection nozzles. These pipelines can be of substantial length and in some applications it is desirable to mount the injection nozzle directly on the apparatus to form what it is known in the art as a unit injector. In this case each cylinder of the engine is provided with a unit injector. An example of an apparatus in accordance with the invention but constructed using the unit injector principle will now be described with reference to FIG. 8 of the drawings.

Referring to FIG. 8 the apparatus includes a body 60 upon which is mounted a fuel injection nozzle 61. The body defines a pair of opposed bores 62, 63 in which are mounted plungers 64, 65 respectively. The plunger 64 together with the bore 62 defines the so-called first pump chamber 66 and the plunger 65 together with the bore 63 defines the second pump chamber 67. The inner ends of the plungers are interconnected so that the two plungers operate in synchronism and together form the equivalent of one of the plungers 15 of the first example. The plungers are positively actuated by a cam or cams driven in timed relationship with the associated engine. A fuel inlet 68 communicates with the pump chamber 67 by way of a non-return valve 69, this corresponding to the non-return valve 23 of the example already described. Moreover, the pump chamber 67 is connected to an accumulator chamber 70 by way of a non-return valve 71, this valve corresponding to the valve 28 of the earlier example. As in the earlier example, the accumulator includes a spring loaded piston 72 which is contained within a cylinder defined in the body.

Also formed in the body is a cylinder 73 in which is mounted a slidable shuttle 74. One end of the cylinder 73 is connected to the inlet of the fuel injection nozzle 61 and the other end of the cylinder is connected to the accumulator chamber 70 by way of an electromagnetically operable valve 75. Moreover, formed in the wall of the cylinder 73 is a port 76 corresponding to the port 33 of the previous example, the port 76 being connected to the accumulator chamber.

In the earlier example the rotary distributor member was able to perform the function of the rotary member of the first, second and third valve means. In this example however there is no equivalent of the rotary distributor member and therefore the aforesaid valve means are constituted by non-return valves. The first valve means comprises a non-return valve 77 which connects the one end of the cylinder 73 with the pump chamber 67, the valve 77 being arranged to permit fuel to flow into the one end of the cylinder.

The second valve means is constituted by a non-return valve 78 which is located in a passage connecting the pump chamber 66 with the accumulator chamber 70. Finally the third valve means is constituted by a non-return valve 79 located in a passage connecting the pump chamber 66 with the other end of the cylinder 73.

In operation, and considering the parts in the position shown in FIG. 8, fuel is being displaced from the pump chamber 67 to the one end of the cylinder 73 past the non-return valve 77. The valve 71 is closed and the valve 75 is opened. When it is judged that sufficient fuel has flowed into the one end of the cylinder, the valve 75 is closed to halt the movement of the shuttle and the surplus fuel displaced by the plunger 65 flows to the accumulator chamber 70 by way of the non-return valve 71.

As the plungers move in the opposite direction i.e. downwardly in FIG. 8, fuel will be displaced from the pump chamber 66 and if the valve 75 is open, the fuel will flow past the valve 79 and the valve 75 to the accumulator chamber. To obtain delivery of fuel the valve 75 is closed and fuel then flows into the other end of the cylinder 73 to displace the shuttle 74 towards the one end of the bore and to the injection nozzle. This flow of fuel will continue until the shuttle uncovers the port 76 whereupon the remaining quantity of fuel which is displaced by the plunger 64 will flow to the accumulator chamber. In the meantime the volume of the pump chamber 67 is increasing and fuel is drawn into the pump chamber from the inlet 68 by way of the non-return valve 69. When the plungers start to move upwardly the non-return valve 78 opens to allow fuel to flow into the pump chamber 66 from the accumulator chamber 70 and furthermore, fuel is displaced from the pump chamber 67 and flows by way of the non-return valve 77 into the one end of the cylinder thereby displacing, providing the valve 75 is open, the shuttle 74 towards the other end of the cylinder. If the valve 75 is closed as when the required movement of the shuttle has taken place, the surplus fuel displaced from the pump chamber 67 flows by way of the non-return valve 71 to the accumulator chamber. It will be appreciated that the valve 77 must open at a lower pressure than the valve 71 in order to ensure that the fuel flows to the one end of the cylinder 73 in preference to flowing to the accumulator chamber 70.

The modifications illustrated in FIGS. 6 and 7 can be applied to the apparatus shown in FIG. 8 if so required.

In both examples it is the closure of the spill valve 34 which is utilized to determine the quantity of fuel supplied by the apparatus and also the start of delivery of fuel. The design of the spill valve and the associated actuator is therefore much simpler.

I claim:

1. A fuel pumping apparatus for supplying fuel to a combustion chamber of a compression ignition engine comprising in combination, a pumping plunger housed within a bore, means driven by a drive shaft which is connected in use to or forms part of a rotary part of the engine for positively reciprocating the plunger within the bore, the bore defining with the plunger first and second pump chambers, the volume of the second chamber increasing and that of the first chamber decreasing during movement of the plunger in a fuel delivery direction and vice versa as the plunger is moved in the opposite fuel filling direction, a shuttle slidable within a cylinder, an outlet from one end of the cylinder for connection in use to a fuel injection nozzle of the associated engine, a fuel inlet to said second chamber, a first non-return valve in said fuel inlet arranged to allow fuel flow into said second chamber, an accumulator in which fuel can be stored under pressure, a second non-return valve in a conduit connecting said second chamber with said accumulator, first valve means operable to connect said second chamber with said one end of the cylinder whereby during movement of the plunger in the filling direction fuel will flow to said one end of the cylinder and displace said shuttle, said second non-return valve being set to open at a higher pressure than is required to cause movement of the shuttle, an electromagnetically operated valve connected in a flow path between the other end of the cylinder and the accumulator, said electromagnetically operable valve being operable to prevent escape of fuel from the other end of the cylinder during movement of the shuttle away from said one end of the cylinder thereby to determine the excursion of the shuttle, second valve means operable to connect said first chamber with said accumulator during movement of the pumping plunger in the filling direction and third valve means operable to connect said first chamber with the other end of the cylinder during movement of the pumping plunger in the pumping direction.

2. An apparatus according to claim 1 including a spill port formed in the wall of said cylinder, said spill port being uncovered by the shuttle after a predetermined movement of the shuttle towards said one end of the cylinder thereby halting the movement of the shuttle.

3. An apparatus according to claim 1 in which said spill port is connected to said accumulator.

4. An apparatus according to claim 3 including valve means operable to connect said one end of the cylinder to a drain immediately prior to the spill port being uncovered by the shuttle.

5. An apparatus according to claim 4 in which said valve means comprises a resiliently loaded valve member disposed at said one end of the cylinder, said valve member being positioned to be engaged by the shuttle to open the valve means during movement of the shuttle towards said one end of the cylinder.

6. An apparatus according to claim 4 in which said valve means comprises a port in the wall of the cylinder and a passage in said shuttle, said passage communicating with said one end of the cylinder and being positioned so that it registers with said port immediately prior to the spill port being uncovered by the shuttle.

7. An apparatus according to claim 6 including spring means operable to prevent overtravel of the shuttle, said spring means acting to urge the shuttle away from said one end of the cylinder by an amount sufficient to cause closure of the passage and port.

8. An apparatus according to claim 4 including a restrictor disposed downstream of said valve means.

9. An apparatus according to claim 4 or claim 8 in which the drain is defined by the accumulator.

10. An apparatus according to claim 7 in which said port is positioned to be uncovered by the shuttle during its movement away from said one end of the cylinder thereby to limit the maximum movement of the shuttle.

11. An apparatus according to claim 1 including a rotary distributor member, said bore being formed in said distributor member, cam means surrounding the distributor member, means connecting the plunger with said cam means whereby the plunger will be positively reciprocable during rotation of the distributor member, said first, second and third valve means being formed by co-operating ports in the distributor member and a surrounding body, and further valve means for connecting said one end of the cylinder to a plurality of outlet ports in turn to enable the apparatus to supply fuel to a multi cylinder engine.

12. An apparatus according to claim 1 in which said first, second and third valve means are defined by spring loaded non-return valves respectively, the valve forming said first valve means opening at a lower pressure than said second non-return valve.

* * * * *